United States Patent [19]

Means

[11] Patent Number: 4,851,703

[45] Date of Patent: Jul. 25, 1989

[54] ELECTRO/HYDRAULIC POWER PACK

[76] Inventor: William A. Means, c/o Fenner Fluid Power, Inc., 5885 Eleventh St., Rockford, Ill. 61109-3699

[21] Appl. No.: 183,789

[22] Filed: Apr. 20, 1988

[51] Int. Cl.[4] ..... F04B 49/02

[52] U.S. Cl. ..... 290/1 R; 318/4

[58] Field of Search ..... 290/1 R, 1 A; 318/4; 417/411; 180/306, 65.2

[56] References Cited

U.S. PATENT DOCUMENTS

| | | | |
|---|---|---|---|
| 3,514,219 | 5/1970 | Mitchell et al. | 290/1 R X |
| 3,889,126 | 6/1975 | Ishihara et al. | 290/1 R |
| 4,173,951 | 11/1979 | Ishihara | 290/1 A X |
| 4,559,455 | 12/1985 | Tanaka | 318/4 X |
| 4,613,007 | 9/1986 | Tanaka et al. | 290/1 R X |

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

The power pack includes a permanent magnet d.c. motor energizable by a battery and having a rotatable shaft. The shaft is operable to rotate both (1) an alternator for producing a.c. voltage for use by electrical utilization devices and (2) a hydraulic pump for producing pressurized oil for use by hydraulic utilization devices. When a supply of hydraulic pressure is not required, a valve unloads the pump and causes substantially all of the load of the pump to be removed from the motor so as to enable substantially the entire capacity of the motor to be used to drive the alternator.

7 Claims, 3 Drawing Sheets

ELECTRO/HYDRAULIC POWER PACK

BACKGROUND OF THE INVENTION

This invention relates generally to a system for supplying power to both a pressure-operated utilization device and an electrically operated utilization device.

While the system of the invention is susceptible to many applications, it is particularly useful in connection with mobile man lifts or access platforms. By way of example, a mobile man lift may comprise a self-propelled vehicle having a platform thereon for supporting a worker. The platform is adapted to be raised and lowered by a hydraulic actuator so as to enable the worker to perform tasks at various elevations. Among those tasks may be jobs performed with an electrically operable utilization device such as a tool and particularly a tool adapted for operation from a 115 or 230 volt source of alternating current (a.c.) voltage.

In most commercially available man lifts, there is no a.c. voltage source available on the platform for operating the tool. As a result, it is necessary for the worker to string a long power cord downwardly from the platform to a fixed power outlet located near ground level either inside or outside of a building. Such a cord limits travel of the vehicle and also is cumbersome when the lift is raised and lowered. In addition, it sometimes is necessary to unplug the cord from one outlet and to plug the cord into a different outlet on a frequent basis. Thus, the use of a long power cord makes it more difficult and time-consuming for the worker to perform the tasks at hand.

The platform usually is raised and lowered by a reciprocating hydraulic actuator. The mobile man lift usually includes other reciprocating hydraulic actuators and/or rotary hydraulic actuators for various purposes such as steering, leveling and the like. The hydraulic actuators are adapted to be pressurized by a rotary pump (e.g., a gear pump) associated with a hydraulic reservoir on the vehicle. The pump may be driven either by the main engine or motor of the vehicle or by an auxiliary motor.

SUMMARY OF THE INVENTION

The general aim of the present invention is to simplify apparatus of the above type and to make the use thereof more convenient through the provision of a unique electro/hydraulic power pack adapted to supply both electrical power and hydraulic power to various electrically and hydraulically operated utilization devices.

A more detailed object of the invention is to achieve the foregoing by providing a power pack in which a battery-operated motor serves to drive both an electrical generator and a hydraulic pump by way of a single shaft.

Still another object of the invention is to remove the load of the pump from the motor when a source of hydraulic pressure is not needed and the motor is driving the generator to produce electrical power.

A further object is to remove the pump load from the motor by means of a relatively simple unloading valve which returns pressure fluid directly from the pump to the reservoir when the pump is not required to produce hydraulic pressure.

The invention also resides in the relatively simple and compact construction of the power pack.

These and other objects and advantages of the invention will become more apparent from the following detailed description when taken in conjunction with the accompanying drawings.

DETAILED DESCRIPTION OF THE PREFERRED EMBODIMENT

Figure 1:
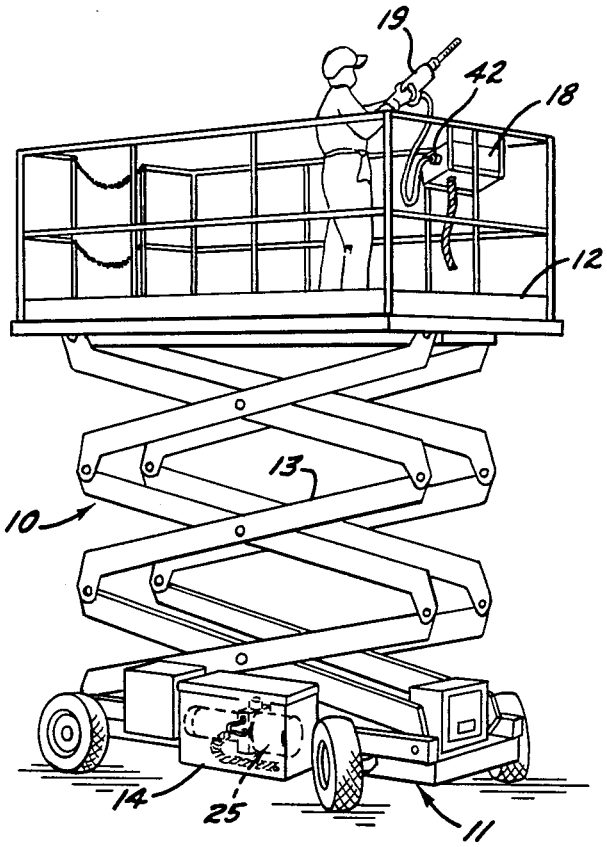
FIG. 1 is a perspective view of a typical man lift equipped with a new and improved power pack incorporating the unique features of the present invention.

Simply for purposes of illustration, the present invention has been shown in the drawings in conjunction with a man lift 10 having a self-propelled vehicle 11, an aerial work platform 12, and a scissors mechanism 13 for raising and lowering the platform. A typical man lift is that sold by Manlift, Inc. of Shady Grove, Penna. under Model No. SM3270E. The vehicle 11 of that model is driven by an electric motor powered by storage batteries (not shown) located in a battery box 14.

Figure 3:
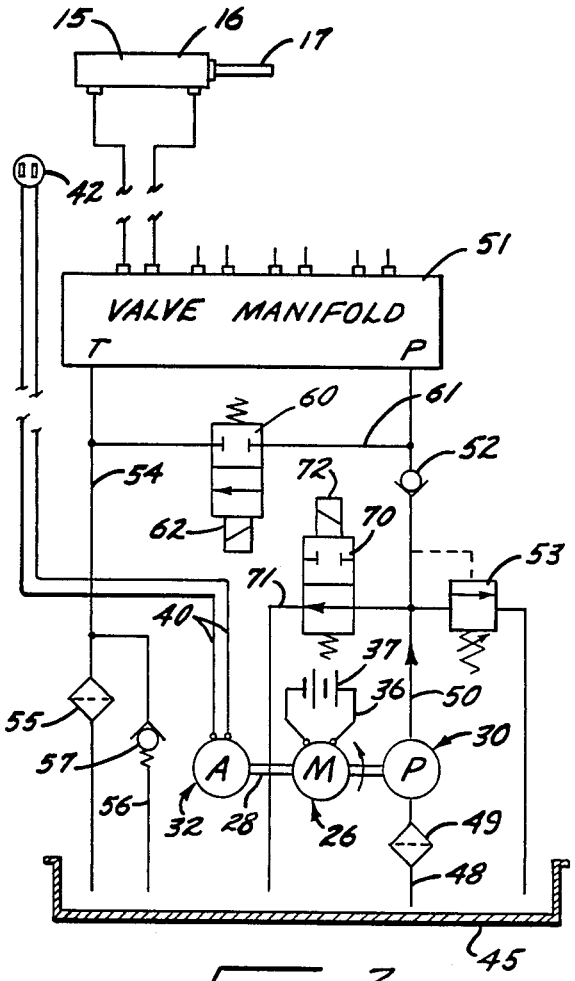
FIG. 3 is a schematic view showing the principal electrical and hydraulic components of the power pack.

Steering of the vehicle 11, raising of the platform 12 and various other functions are effected by various pressure-operated or hydraulic utilization devices or actuators, a typical actuator being indicated at 15 in FIG. 3 and comprising a cylinder 16 with a reciprocating rod 17. A control console 18 (FIG. 1) is associated with the platform 12 and enables a worker on the platform to drive and steer the vehicle and to raise and lower the platform.

The vehicle 11 and the movable platform 12 enable a worker on the platform to perform various tasks at different locations and at different elevations. Frequently, those tasks are performed with an electrically operated utilization device or tool such as an electric drill 19 rated for operation at 230 volts a.c.

In many cases, a source of alternating current voltage is not available at the platform 12. Under such circumstances, it is necessary for the worker to string a power cord down from the platform to a stationary power outlet. The long cord can be troublesome to the worker and must be unplugged whenever the vehicle 11 is moved through any significant distance.

According to the present invention, provision is made of a novel electro/hydraulic power pack 25 which can be used to produce hydraulic power for the actuator 15 and other hydraulic actuators and also to produce electrical power for the tool 19 or other electrical utilization devices. The power pack is particularly characterized by a motor 26 having a shaft 28 which drives both a pump 30 for producing hydraulic power and a generator 32 for producing electrical power. When hydraulic power is not required, the load of the pump 30 is removed from the motor 26 to reduce the power requirements of the motor and to enable substantially all of the motor capacity to be used for producing electrical power. The power pack may be contained within the battery box 14 of the vehicle 11 as shown in FIG. 1.

Figure 2:
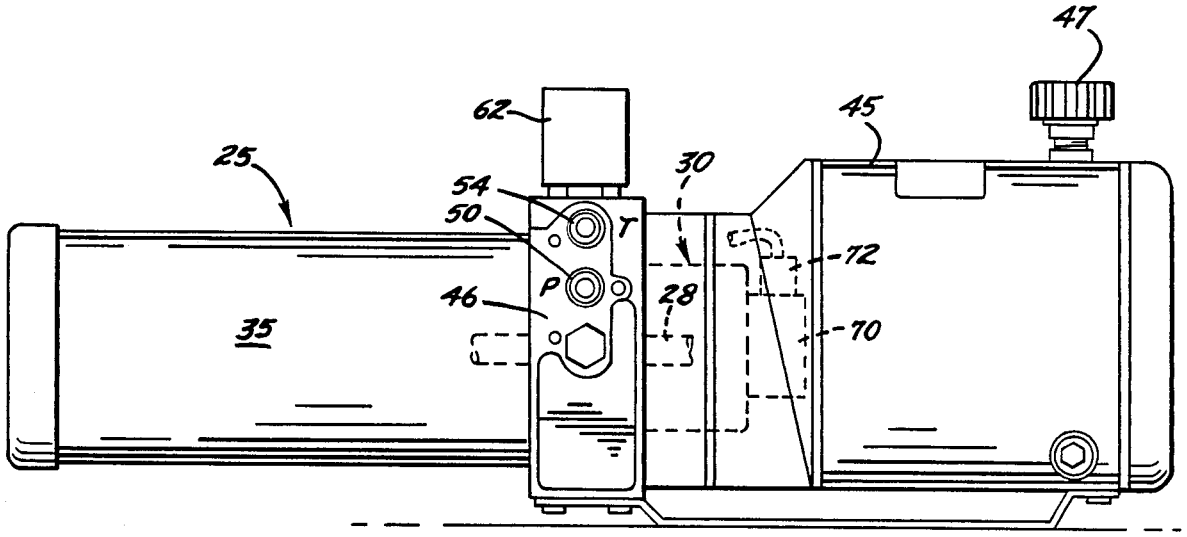
FIG. 2 is a front elevational view of the power pack.

In the present instance, the motor 26 and the generator 32 form part of a motor-generator set. The term "generator" as used herein is intended generically to designate either a d.c. generator or an a.c. generator and the term "alternator" will here be employed to specifically designate the latter. In this particular instance, the generator is an alternator designed and rated to produce (when driven at rated speed by the motor) an operating voltage of 230 volts a.c. The motor 26 and the alternator 32 may be physically separate units of conventional organization with armatures mechanically coupled by the shaft 28. Alternatively, they may have their armature windings mounted on a common rotor carried by the shaft and rotatable within a common stator. In the present instance, the latter construction has been shown in FIG. 2 and thus the common stator is located within a housing 35 which journals the shaft 28. For simplicity, FIG. 3 schematically shows the motor 26 and the alternator 32 as being separate units having rotors connected by the shaft 28.

Herein, the motor 26 is a permanent magnet field type of d.c. motor including permanent magnets (usually carried by the stator within the housing 35) which produce a magnetic field cooperating with the motor armature. The motor includes input leads 36 (FIG. 3) connected to a battery 37 for energizing the motor. The battery may be the battery pack of the vehicle 11 or may be a separate battery which is charged by the generator or alternator of the vehicle.

In carrying out the invention, the alternator 32 includes output terminals connected to output leads 40 (FIG. 3) which are connected to an electrical outlet or jack 42 at the control console 18. As a result, the tool 19 may be plugged directly into the jack 42 to avoid the need for extending a power cord downwardly from the platform 12 to a stationary power outlet.

Further in keeping with the invention and as pointed out above, the pump 26 is driven by the same motor shaft 28 which drives the alternator 32. The pump preferably is a gear pump contained within a housing 45 (FIG. 2) and having an impeller or rotor connected directly to the shaft 28. The housing 45 is connected to one end of the housing 35 by a head 46 and defines a reservoir or tank for hydraulic oil. Oil may be introduced into the tank 45 when a filler cap 47 is removed.

As shown in FIG. 3, the pump 28 includes an inlet line 48 which communicates with the tank 45 by way of a conventional strainer or filter 49. The pump also includes an outlet line 50 which communicates with a valve manifold 51 via a check valve 52, there being an adjustable relief valve 53 associated with the outlet line for limiting the pump pressure. The cylinder 16 of the actuator 15 communicates with the valve manifold 51 as does a line 54 which leads to the tank by way of a filter 55. A bypass line 56 with a check valve 57 communicates with the line 54 upstream of the filter 55 and defines a return to the tank 45 in the event the filter 55 becomes clogged.

A so-called release valve 60 (FIG. 3) is located in a line 61 which extends between the lines 50 and 54. The release valve is normally closed as shown in FIG. 3 and, when closed, causes pressurized oil to flow from the pump outlet line 50 to the valve manifold 51 for flow to the actuator 15 and similar actuators under the control of conventional selector valves (not shown) associated with the valve manifold. When a solenoid 62 shifts the valve 60 to an open position, hydraulic oil bypasses the valve manifold 51 and returns directly to the tank via the lines 61 and 54.

Pursuant to the invention, an unloading valve 70 (FIG. 3) in the tank 45 is located in a line 71 which establishes communication between the pump outlet line 50 and the tank 45. The valve normally is open as shown in FIG. 3 and normally cause hydraulic oil to return directly from the pump 30 to the tank 45 and to bypass the valve manifold 51. Under such conditions, the pump 30 places very little load on the motor 26 since the pressure differential across the pump is very small in magnitude. Upon energization of a solenoid 72, the unloading valve 70 is shifted to a position blocking flow through the line 71 and directing pressurized oil from the pump 30 to the manifold 51 for pressurization of the actuator 15 and/or similar actuators.

Figure 6:
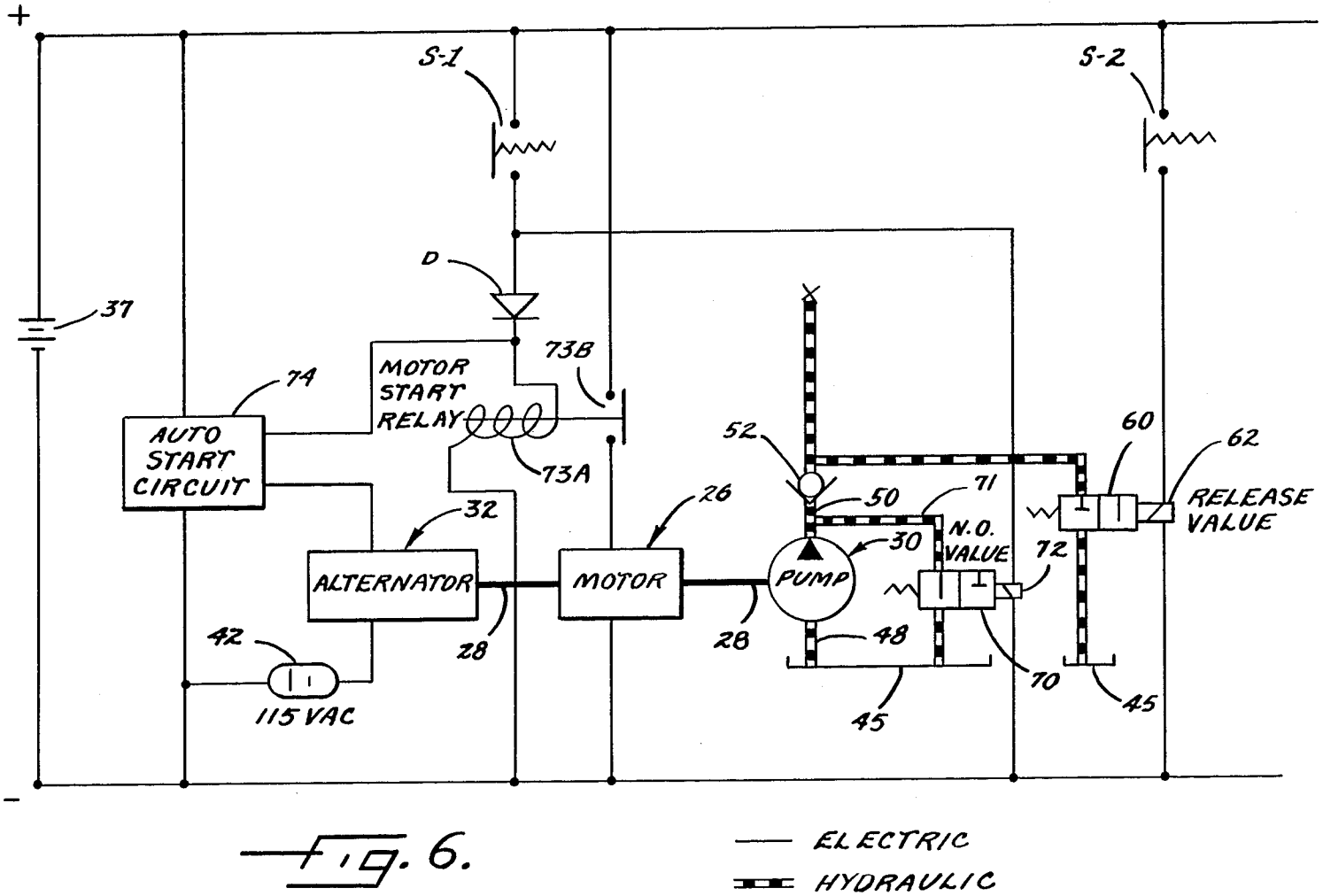
FIG. 6 is a more detailed schematic view of the electrical and hydraulic circuits of the power pack.

A more detailed diagram of the electrical and hydraulic components of the power pack 25 is contained in FIG. 6. As long as switch contacts S-1 are open as shown in FIG. 6, the solenoid 72 is de-energized so that the valve 70 is positioned to cause any oil delivered from the pump 30 to be diverted directly to the tank 45.

When the switch contacts S-1 are closed, the coil 73A of a motor start relay is energized by way of a diode D. When the coil 73A is energized, relay contacts 73B close and effect energization of the motor 26 so that the motor drives the pump 30. Closure of the switch contacts S-1 also energizes the solenoid 72 to cause that solenoid to shift the valve 70 to a position causing oil from the pump to be directed to the manifold 51. If at this time switch contacts S-2 are open, the solenoid 62 is in a de-energized state and causes the valve 60 to be positioned to block flow from the manifold to the tank 45. Accordingly, oil under pressure is delivered to the manifold to effect pressurization of the actuator 15 and/or similar actuators. Since the motor 26 drives the alternator 32 at the same time it drives the pump 30, electrical power is available at the jack 42.

When the switch contacts S-1 are opened, the solenoid 72 is de-energized and the valve 70 is shifted to a position in which oil from the pump 30 is returned directly to the tank 45. If no electrical utilization device 19 is receiving power from the jack 45 at the time the switch contacts S-1 are opened, the relay coil 73A is switched to a de-energized state and opens the relay contacts 73-B to de-energize the motor 26.

By closing the switch contacts S-2, the solenoid 62 may be energized to cause the release valve 60 to be shifted to a position allowing oil to flow from the manifold 5I to the tank 45. As a result, pressure in the manifold may be completely relieved.

Assume now that there is need for electrical power but no need for hydraulic power and assume further that an eIectrical utilization device I9 is plugged into the jack 45. When the on-off switch of the electrical utilization device is closed, an automatic start circuit 74 effects energization of the relay coil 73A. The relay contacts 73B thus are closed to cause the motor 26 to drive the pump 30 and the alternator 32. Electrical power thus is made available at the jack 45. The switch contacts S-1 are open, however, and the diode D prevents the automatic start circuit 74 from energizing the solenoid 72. As a result, the valve 70 remains in a position causing oil from the pump 30 to return directly to the tank 45. Thus, even though the pump is being driven by the motor, it is unloaded and hence substantially all of the power of the motor is available to drive the alternator 32 and create electrical power.

To summarize, a.c. voltage is always available at the jack 42 for by the tool 19 whenever the motor 26 is powered by the battery 37 and a circuit is completed between the jack and the alternator 32. As long as the solenoid 62 is de-energized and as long as the solenoid 72 is energized, the pump 30 supplies oil under pressure to the valve manifold 51. When the solenoid 72 is de-energized, the valve 70 is shifted to a position unloading the pump 30 and removing substantially all of the load thereof from the motor 26. Under such circumstances, substantially the entire capacity of the motor is used to drive the alternator 32 and thus is available for creating electrical power.

Figure 4:
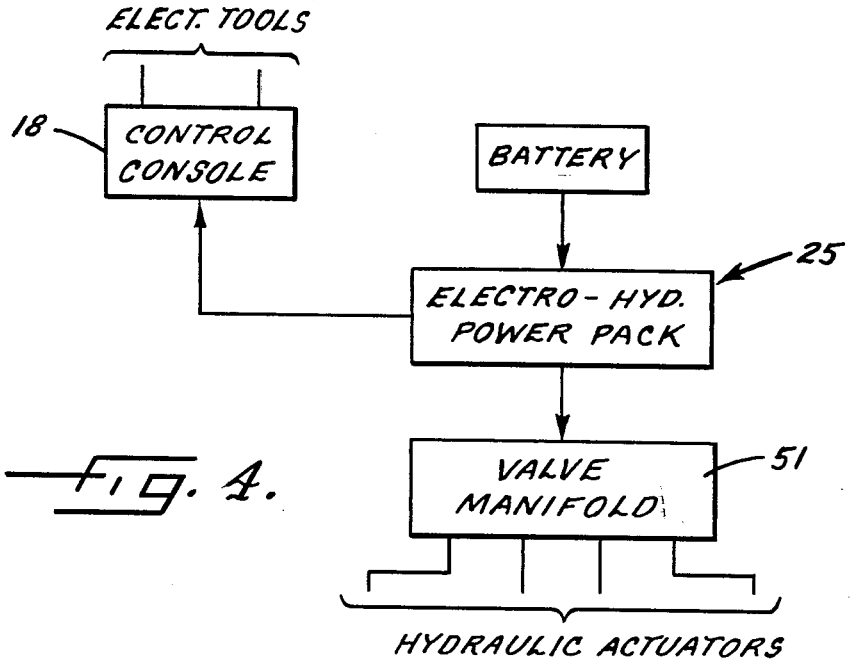
FIG. 4 is a view schematically showing the power pack as used with a particular type of vehicle.

FIG. 4 is a simplified block diagram of the power pack 25 of the invention when the power pack is used in conjunction with an electrically propelled vehicle 11. In such an instance, the battery (or primary electrical system of the vehicle) supplies voltage to the power pack to drive the motor 26. The alternator 32 produces electrical power for use by electrical tools plugged into the jack 42 at the control console 18. When the valve 70 is shifted from its unloading position, the pump 30 supplies oil under pressure to the valve manifold 51 to enable operation of the hydraulic actuators.

Figure 5:
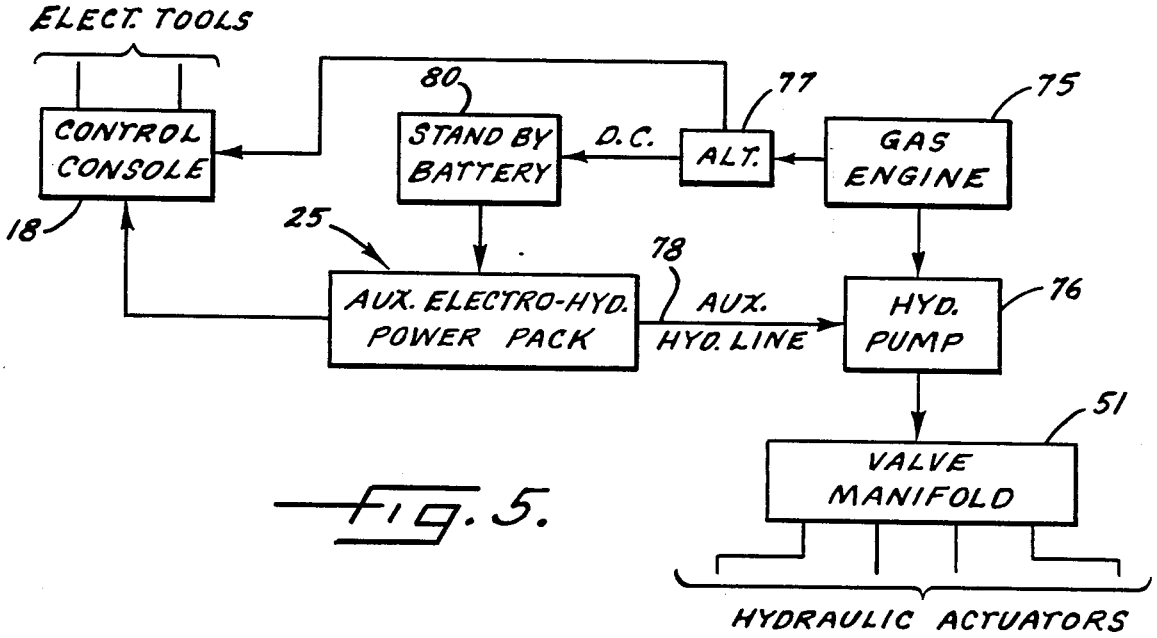
FIG. 5 is a view schematically showing the power pack as used with a different type of vehicle.

In the system shown in FIG. 5, the vehicle 11 is driven by a gasoline engine 75 which normally drives a main hydraulic pump 76 to supply oil under pressure to the valve manifold 51. The engine also normally drives a main alternator 77 to supply electrical power to the electric utilization devices via the control console 18. In a system of this type, the electro/hydraulic power pack 25 of the invention serves as an auxiliary power pack. Thus, in the event of stoppage of the engine 75, the power pack 25 supplies pressurized oil to the valve manifold 51 via an auxiliary line 78 and the pump 30. The motor 26 of the power pack is adapted to be energized by a standby battery 80 while the alternator 32 of the power pack supplies voltage to the control console 18 in the same manner as before.

From the foregoing, it will be apparent that the present invention brings to the art a new and improved power pack 25 in which the shaft 28 of a motor 26 drives both a pump 30 and an alternator 32 to produce hydraulic and electric power. The unloading valve 70 enables the pump to run idly and without imposing substantial load on the motor. While the power pack has been disclosed specifically in conjunction with a man lift 10 having a scissors-supported platform 12, those familiar with the art will appreciate that the power pack can be used equally well with other types of lifts or access platforms such as, for example, boom lifts. Indeed, the power pack may be used advantageously in most any application where both hydraulic and electric power are required.

I claim:

1. A system for supplying power to an electrically operated utilization device and to a pressure-operated utilization device, said system comprising an electrically energizable motor having a rotary shaft, a generator having a rotor associated with said shaft and operable when rotated by said shaft to produce voltage for selective supply to said electrically operated utilization device, a pump having a rotor connected to said shaft and operable when rotated by said shaft to pressurize fluid for selective supply to said pressure-operated utilization device, and selectively operable means for removing a substantial part of the load of said pump from said motor when said generator is supplying voltage to said electrical utilization device.

2. A system as defined in claim 1 further comprising a reservoir for hydraulic oil, said pump having an inlet for receiving oil from said reservoir and having an outlet for supplying oil under pressure, said selectively operable means comprising a valve selectively movable between a first position supplying oil from said outlet to said pressure-operated utilization device and a second position returning oil from said outlet directly to said reservoir while bypassing said pressure-operated utilization device.

3. A system as defined in claim 2 further including an electrically energizable solenoid for moving said valve between said positions.

4. A system as defined in claim 1 further including a housing supporting said shaft for rotation, said motor comprising an armature located in said housing and rotatable with said shaft, and the rotor of said generator comprising an armature located in said housing and rotatable with said shaft.

5. A system for supplying power to (a) a hydraulically operated actuator and (b) an electrically operated utilization device rated for operation from an a.c. voltage and adapted to be plugged into an electrical jack, said system comprising a motor-alternator set having a motor adapted for connection to and energization by a battery, said motor having a shaft which is rotated when said motor is energized by said battery, said motor-alternator set further comprising an alternator rated to produce an a.c. voltage corresponding substantially to the rated operation voltage of said electrical utilization device, said alternator having a rotor rotatable by said shaft and having output terminals adapted for connection to said jack so as to supply rated voltage to said utilization device when the latter is plugged into said jack and when said rotor is rotated by said shaft, a pump having a rotor connected to and adapted to be rotated by said shaft, a reservoir for hydraulic oil, said pump having an inlet for receiving oil from said reservoir and having an outlet for supplying oil under pressure, a valve movable between a first position supplying oil from said outlet to said hydraulically operated actuator and a second position returning oil from said outlet directly to said reservoir while bypassing said actuator, and means for shifting said valve to said second position when said alternator is supplying voltage to said electrical utilization device thereby to unload said pump and remove substantial load from said motor.

6. A system as defined in claim 5 in which said motor-alternator set includes a housing, said shaft being rotatably supported by said housing, said motor having an armature located within said housing and rotatable with said shaft, and the rotor of said alternator comprising an armature located in said housing and rotatable with said shaft.

7. A system for supplying power to (a) a hydraulically operated actuator adapted to raise and lower a lift and (b) an electrically operated utilization device rated for operation from an a.c. voltage and adapted to be plugged into an electrical jack on the lift, said system comprising a motor-alternator set having a housing and having a shaft rotatable in said housing, said motor-alternator set comprising a permanent magnet d.c. motor adapted for connection to and energization by a battery, said motor having an armature located in said housing and rotatable with said shaft, said motor-alternator set further comprising an alternator rated to produce an a.c. voltage corresponding substantially to the rated operation voltage of said electrical utilization device, said alternator comprising an armature located in said housing and rotatable with said shaft, said alternator having output terminals adapted for connection to said jack so as to supply voltage to said electrical utilization device when the latter is plugged into said jack, a pump having a rotor connected to and adapted to be rotated by said shaft, a reservoir for hydraulic oil, said pump having an inlet for receiving oil from said reservoir and having an outlet for supplying oil under pressure, a valve movable between a first position supplying oil from said outlet to said hydraulically operated actuator and a second position returning oil from said outlet directly to said reservoir while bypassing said actuator, and means for shifting said valve to said second position when said alternator is supplying voltage to said electrical utilization device thereby to unload said pump and remove substantial load from said motor.

* * * * *